US006152228A

United States Patent [19]

Carmichael

[11] Patent Number: 6,152,228

[45] **Date of Patent: *Nov. 28, 2000**

[54] APPARATUS AND METHOD FOR CIRCULATING FLUID IN A BOREHOLE

[75] Inventor: Mark Carmichael, Aberdeenshire, United Kingdom

[73] Assignee: Specialised Petroleum Services Limited, Aberdeen, United Kingdom

[ * ] Notice: This patent issued on a continued prosecution application filed under 37 CFR 1.53(d), and is subject to the twenty year patent term provisions of 35 U.S.C. 154(a)(2).

[21] Appl. No.: 09/077,399

[22] PCT Filed: Nov. 27, 1997

[86] PCT No.: PCT/GB97/03182

§ 371 Date: May 28, 1998

§ 102(e) Date: May 28, 1998

[87] PCT Pub. No.: WO98/23841

PCT Pub. Date: Jun. 4, 1998

[30] Foreign Application Priority Data

Nov. 27, 1996 [GB] United Kingdom ..... 9624577
Apr. 1, 1997 [GB] United Kingdom ..... 9706610

[51] Int. Cl.[7] ..... E21B 21/10

[52] U.S. Cl. ..... 166/312; 166/333.1; 166/222; 166/334.4

[58] Field of Search ..... 166/333.1, 222, 166/312, 334.4, 334.2, 240, 332.1, 332.5

[56] References Cited

U.S. PATENT DOCUMENTS 1,360,053 11/1920 Stumpf ..... 166/240
3,364,996 1/1968 Brown .
3,907,046 9/1975 Gaylord .
4,300,636 11/1981 Lawrence ..... 166/334
4,315,542 2/1982 Dockins, Jr. .
4,637,471 1/1987 Soderberg .
4,991,653 2/1991 Schwegman ..... 166/312
5,082,062 1/1992 Wood et al. .

FOREIGN PATENT DOCUMENTS 2272923 6/1994 United Kingdom .

*Primary Examiner*—David Bagnell
*Assistant Examiner*—Zakiya Walker
*Attorney, Agent, or Firm*—Clifford W. Browning; Woodard, Emhardt, Naughton, Moriarty & McNett

[57] ABSTRACT

An apparatus and method for circulating fluid in a borehole is described. The apparatus comprises a tubular assembly (1; 40; 60) which has an axial through passage (21, 18; 47; 19) between a fluid inlet (21) and first fluid outlet (19). The fluid inlet (21) and the first fluid outlet (19) are connected (13, 20) in a work string which is supported from the surface above the borehole. There is a second outlet (16; 42, 48) which extends generally transversely of the assembly (1; 40; 60). An obturating member (9) is moveable between a first position in which the second fluid outlet (16; 42, 48) is closed and a second position which permits fluid flow through the second outlet (16; 42, 48). An engagement mechanism (12, 6, 7; 68, 69) is moveable between an engaged configuration in which the obturating member (9) is maintained in one of the first and second positions, and a disengaged configuration in which the obturating member (9) is in the other of the first and second positions. The tubular assembly (1; 40; 60) is coupled to a shoulder which is engageable with the formation in the borehole to engage or disengage the engagement mechanism (12, 6, 7; 68, 69). Setting down weight on the work string may cause a formation of the borehole to exert a force on the shoulder which may result in the second outlet (16; 42, 48) being opened.

24 Claims, 5 Drawing Sheets

APPARATUS AND METHOD FOR CIRCULATING FLUID IN A BOREHOLE

The invention relates to apparatus and a method for circulating fluid in a borehole.

It is common practice to install liners within a borehole which has been drilled. After installation of the liners it is generally necessary to clean out the inside of the liner to wash away any debris or other contaminants.

Generally, the liner is in the form of a cylindrical tube which has a relatively small internal diameter compared with the diameter of casing lining the borehole immediately above the liner. To clean out effectively inside the liner, high flow velocities are generally required to create turbulence to aid the cleaning out process. Generally, the clean out procedure is carried out by first passing cleaning liquid through a "work string" inserted into the liner, to exit from the work string at the lower end of the liner at a high flow rate so that the cleaning fluid flows turbulently up the annulus between the inside of the liner and the outside of the work string and then into the casing above the liner.

Generally, the "work string" is made up of a number of lengths of drill pipe, or other tubulars, threadedly connected together to form the work string, which may also be referred to as the "drill string".

However, because of the difference in volume between the liner and the casing above the liner, after the cleaning fluid passes the top of the liner and enters the relatively large volume of the casing, the flow velocity of the cleaning fluid in the casing above the liner is greatly reduced and any cleaning action becomes negligible.

Hence, it is generally necessary after passing cleaning fluid through the liner to then pass further cleaning fluid from the work string into the casing at a location above or adjacent the top edge of the liner, so that a high flow rate and hence turbulence of the cleaning fluid can be obtained in the casing. Therefore, it is generally necessary to have some device at or adjacent to the top end of the liner which can be operated downhole to either circulate fluid through the length of the work string to the lower end of the liner or which can direct cleaning fluid at high flow rates out of the work string into the casing above the liner, at or adjacent the top edge of the liner.

One such device that is known for carrying out this operation comprises a hollow body member and in order to change the direction of flow between the bottom of the liner and the top edge of the liner, spherical balls are dropped down the work string to open or close valves in the device.

However, there are a number of disadvantages associated with this apparatus. In particular, the length of time associated with the spherical balls falling from the surface to the device through a work string which is perhaps a few thousand feet in length can take 25 to 30 minutes. Hence, there is a problem with coordinating the arrival of the spherical ball at the apparatus to coincide with the arrival of the required cleaning fluid at the apparatus. It is also necessary to ensure that the increasing and decreasing flow velocities associated with the liner and the casing clean out are coordinated with the arrival of the spherical ball at the apparatus.

In accordance with the present invention, apparatus for circulating fluid in a borehole comprises a tubular assembly having a through passage between an inlet and a first outlet, the inlet and the first outlet being adapted for connection in a work string, a second outlet extending generally transversely of the assembly;

an obturating member movable between a first position closing the second outlet and a second position permitting fluid flow through the second outlet; and an engagement mechanism actuable between an engaged configuration, in which the obturating member is maintained in one of the first and the second positions, and a disengaged configuration, in which the obturating member can move to the other of the first and the second positions;

and the apparatus being coupled to a shoulder which is engageable with a formation in the borehole to engage or disengage the engagement mechanism.

Preferably, the obturating member of the apparatus is coupled to the shoulder.

Preferably, the formation in the borehole may be a shoulder portion in the borehole, but can be provided by any formation capable of resisting movement of the string.

The shoulder portion may be part of the equipment installed in the well bore as part of the well casing or liner, and may include casing cross-overs and liner equipment, such as polished bore receptacles (PBRs), profile subs, liner hangers or liner top packers.

The shoulder portion may be provided by a recess or a protrusion on the inner surface of the equipment, or by a gradual or stepped reduction in internal diameter of the well casing or liner, for example the top edge of a liner within the borehole.

Alternatively, the formation may be the bottom of the borehole, and the shoulder may be the lowest end of the work string.

The shoulder to which the obturating member is coupled is preferably a change (gradual or stepped) in outside diameter which is permitted to contact the formation in the borehole. The shoulder may form part of the apparatus or be a separate item of equipment located in the string below the apparatus. Examples of suitable shoulders which may be coupled to the obturating member and located in the string below the apparatus are a liner top dressing mill, a stabiliser, a bearing sub, or a sprung loaded dog assembly.

Preferably, the obturating member is axially slidable within the tubular assembly.

Typically, the engagement mechanism may comprise mutually engageable formations on each of the obturating member and the tubular assembly. Preferably, the engageable formations comprise a member and a recess in which the member may be engaged. The member may comprise a pin and the recess may comprise a slot. Preferably, one of the pin and the slot is mounted on the obturating member and the other is mounted on the tubular assembly, the pin preferably being engaged with the slot when the engagement mechanism is in the engaged configuration and the pin preferably being disengaged from the slot when the engagement mechanism is in the disengaged configuration. Typically, the slot extends circumferentially around the respective tubular assembly or the obturating member and the pin may move circumferentially with respect to the slot.

Preferably, the slot and/or pin is configured such that the pin and slot move in only one direction with respect to each other when engaged and operated.

In one example of the invention, the obturating member is in the first position when the engagement mechanism is in the engaged position.

In another example of the invention, the obturating member is in the second position when the engagement mechanism is in the engaged position.

Preferably, the second outlet comprises a number of apertures in the tubular assembly which communicate with the inlet. Typically, the apertures may be distributed circumferentially around the outer surface of the tubular assembly.

Typically, the cross-sectional area of the first outlet is greater than the cross-sectional area of the second outlet.

The apertures may be designed to direct the fluid exiting the second outlet in an upwards or downwards direction into the well bore.

In accordance with another aspect of the invention, a method of circulating fluid in a borehole comprises inserting a work string into the borehole, the work string having a fluid inlet, a first fluid outlet and a second fluid outlet, an obturating member which is moveable between a first and second position to respectively close and open the second fluid outlet, and an engagement mechanism which when engaged maintains the obturating member in one of the first or second positions, and a shoulder which is engageable with a formation in the borehole to engage or disengage the engagement mechanism;

passing a desired cleaning fluid through the work string into the fluid inlet and thence via the first outlet to the interior of the borehole; setting down weight on the work string to move the obturating member to the second position to open the second outlet and the engagement mechanism to the engaged or the disengaged configuration and passing the cleaning fluid through the work string into the inlet and thence via the second outlet to the interior of the borehole.

When the engagement mechanism is disengaged, the obturating member is capable of moving to the respective other position.

Setting down weight on the string preferably causes the formation in the borehole to exert a force on the shoulder so as to move the obturating member and the engagement mechanism.

Preferably, the method further includes picking up weight of the string to reduce the force exerted by the formation in the borehole on the shoulder.

Preferably, the method further includes subsequently resetting down weight on the work string, such that the engagement mechanism is moved to the other of the respective engaged or disengaged configuration to move the obturating member to the first position to close the second outlet.

Preferably, the steps of picking up and setting down the weight of the string may be repeated to cycle opening and closing of the second outlet.

Two embodiments of apparatus and a method for circulating fluid in a borehole in accordance with the invention will now be described, by way of examples only, with reference to the accompanying drawings, in which.

Figure 4A:
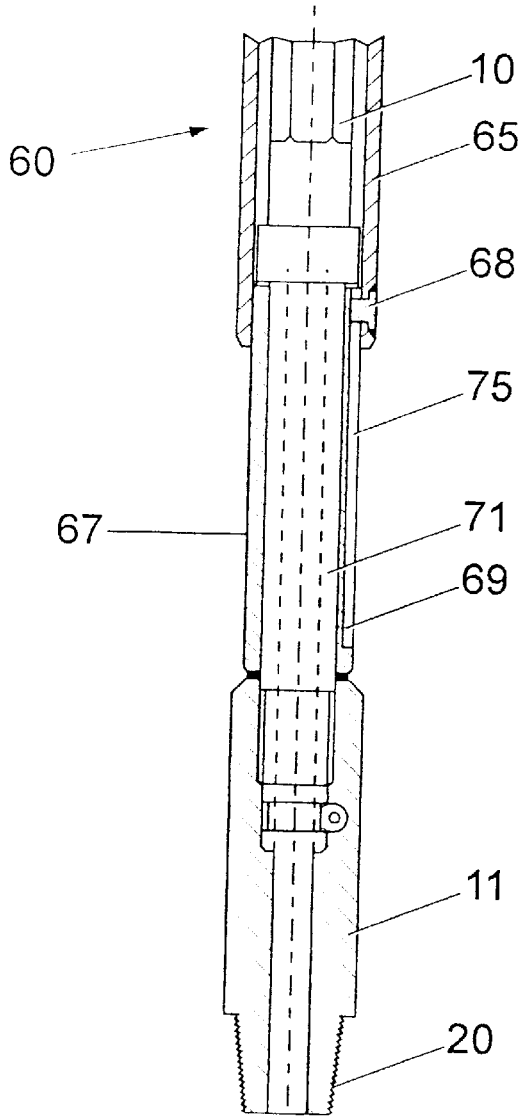
Figure 5:
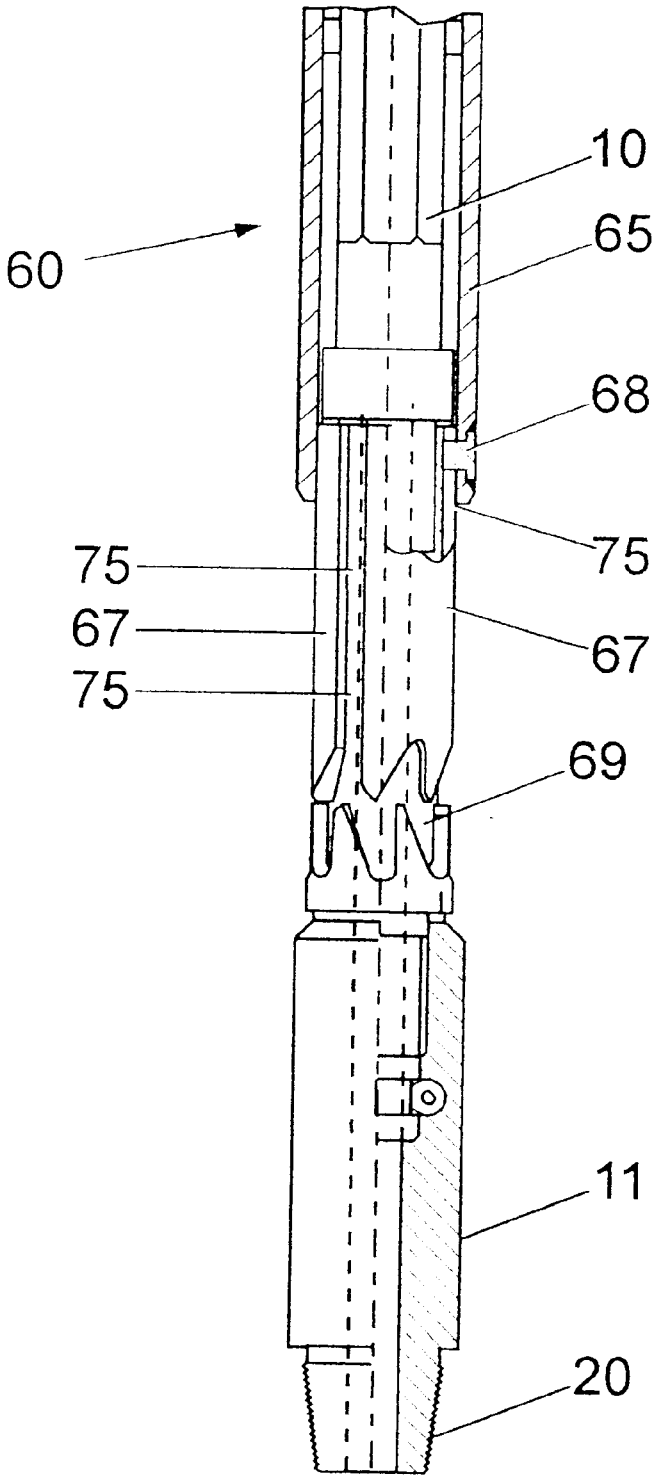

FIGS. 4*a* and *b* are cross-sectional views of a third example of a circulating tool; and FIG. 5 is a partial cross-sectional view of a portion of the circulating tool of FIGS. 4*a* and *b*.

Figure 1:
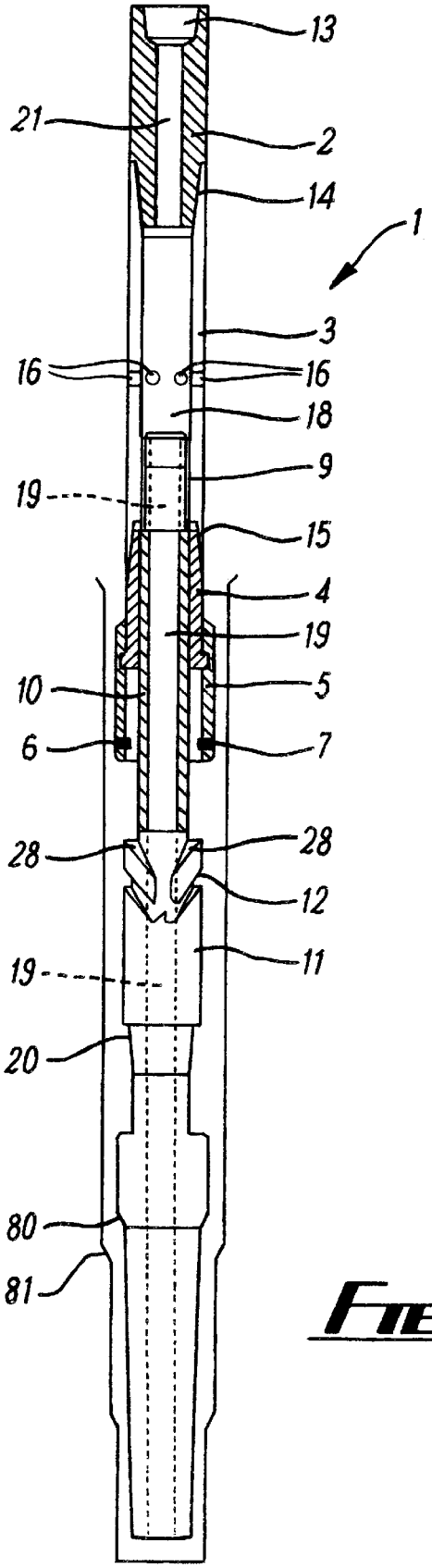
FIG. 1 is a partial cross-sectional view through a first example of a circulating tool.

FIG. 1 shows a circulating tool 1 which includes a tubular assembly which comprises a top sub 2, a main housing 3, a bottom sub 4 and a pin housing 5 with two pins 6, 7 mounted thereon and directed radially inwards of the pin housing 5.

Slidably mounted within the tubular assembly is an obturating member which comprises a seal piston member 9 connected to an inner mandrel 10 which includes a mandrel bottom sub 11 which has a slot 12 formed therein.

The top sub 2 includes a female threaded box connection 13 and is threadedly connected at 14 to the main housing 3. The main housing 3 is threadedly connected at 15 to the bottom sub 4. Located within the main housing 3 are a number of outlet ports 16 which extend from a through bore 18 in the main housing 3 to the external surface of the main housing 3. A through bore 19 extends through the obturating member through the piston member 9, inner mandrel 10 and mandrel bottom sub 11 to exit the obturating member at the lower end of the mandrel bottom sub 11 which is terminated in a threaded pin connection 20. In addition, the top sub 2 also has a through bore 21 which extends through the top sub 2 from the box connection 13.

The pin housing 5 is rotatably mounted on the bottom sub 4 and the inner mandrel 10 is keyed to the bottom sub 4 with mutually engageable formations (not shown), such that the inner mandrel 10 (and hence the obturating member) slides within the bottom sub 4 (and hence the tubular assembly) but is prevented from rotating with respect to the bottom sub 4. This enables torque to be applied through the tubular assembly to the obturating member to rotate equipment connected to the tool 1 below the obturating member.

In use, the tool 1 is connected into a work string, which may comprise lengths of drill pipe connected to the tool 1 via the box connection 13 and the pin connection 20.

A shoulder, such as a top dressing mill (not shown) is connected into the work string below the tool 1.

Figure 3:
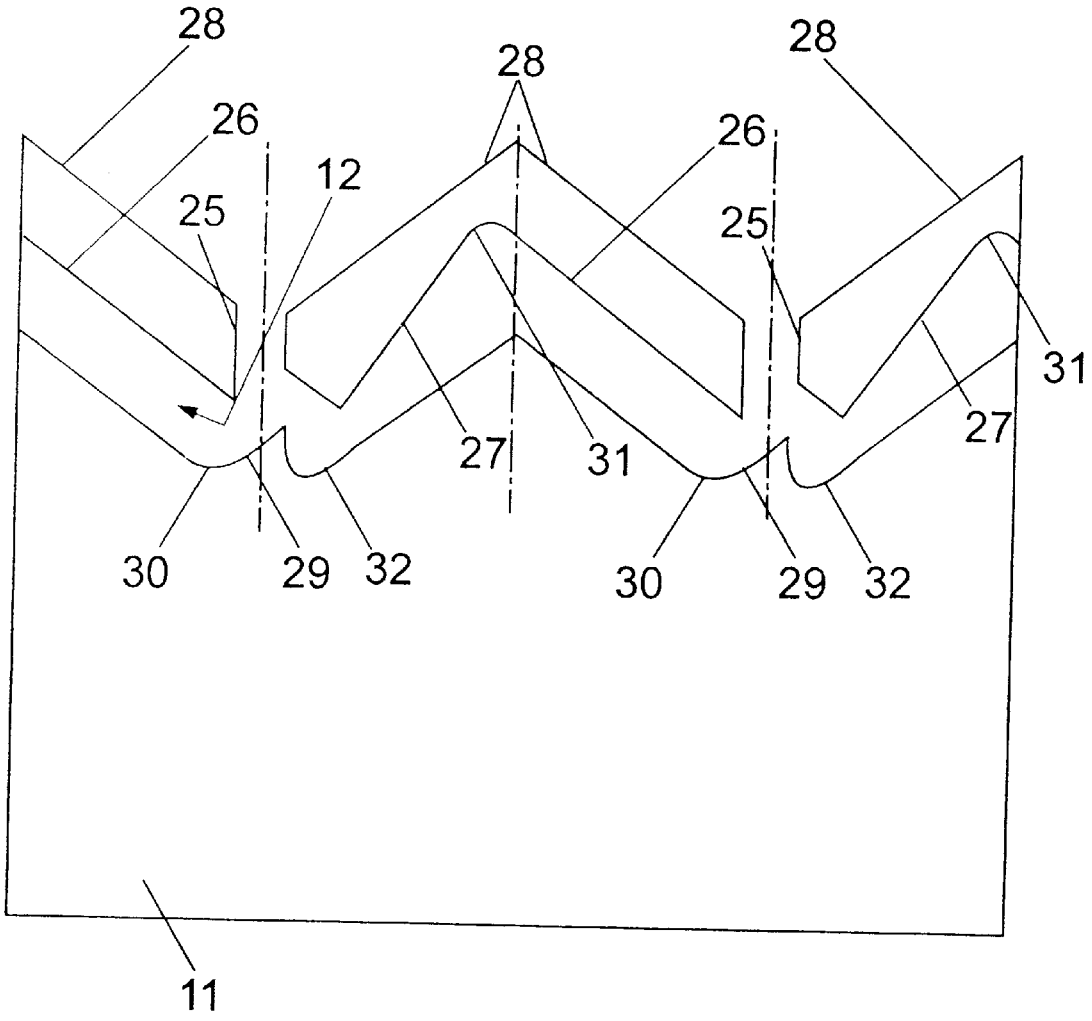
FIG. 3 is a flat view of an engagement slot for the tools shown in FIGS. 1 and 2.

A flat view of the slot 12 is shown in FIG. 3 where it can be seen that the slot 12 includes two exit/entry slots 25. In use, the mandrel bottom sub 11 is pushed towards the bottom sub 4 until the pins 6, 7 contact surfaces 28 adjacent the exit/entry slots 25. Further pushing together of the mandrel bottom sub 11 and the bottom sub 4 causes rotation of the pin housing 5 relative to the bottom sub 4 so that the pins 6, 7 move down the surfaces 28 towards the respective exit/entry slots 25 and enter the respective slots 25. The pins 6, 7 then strike formations 29 in the slot 12 and are directed into the apex portions 30 of the slot 12. When the work string is inserted into the well, the weight of drill pipe and other equipment connected to connection 20 of the obturating member pulls the obturating member downwards with respect to the tubular assembly causing the pin 6 to enter slot portion 26 and rise up slot portion 26 until the pins contact apex portions 31.

When the pins 6, 7 are in the respective apex portions 31, the piston member 9 is located between the outlet port 16 and the top sub 2 such that the piston member 9 prevents fluid flow from the through bore 21 to the outlet port 16. Hence, fluid entering the tool 1 through the through bore 21 passes through the through bore 19 and the obturating member and into the work string below the tool 1.

When it is desired to open the outlet port 16 to fluid flowing into the tool 1 through the through bore 21, the shoulder, such as the top dress mill 80 is contacted against a shoulder portion 81 in the borehole, such as a liner top (not shown). Subsequent setting down of weight of the work string above the tool 1 causes the tubular assembly to move downward with respect to the obturating member and the pins 6, 7 move into slot portions 27 until they rest in the apex portions 32. Subsequent picking up of the weight of the work string above the tool 1 causes the tubular assembly to move upwards with respect to the obturating member and the pins 6, 7 move into the exit/entry slots 25 and then out of the slot 12 so that the tool 1 moves to the position shown in FIG. 1. In this position fluid pumped through the upper portion of the work string above the tool 1 enters the tool 1 through the through bore 21, enters the through bore 18 in the main body housing 3 and passes out of the main body housing 3 through the outlet ports 16. This occurs as it is easier for the fluid to pass out through the outlet ports 16 than to enter through bore 19 and obturating member and flow out of the work string through the bottom end of the work string. Hence, this permits the tool 1 to be used to circulate fluid out through the side of the main housing 3 and washout casing above the liner top.

It is possible to halt circulation of the fluid out through the side of the main housing 3 through the port 16, and permit the fluid to be repumped through the throughbore 19 by observing the following operation. Setting down of weight of the work string above the tool 1 again, causes the tubular assembly to move downward so that pins 6, 7 enter their respective slots 25 until they strike the apex portions 30. The outlet ports 16 are now obturated by the piston member 9, and accordingly, all the fluid will now flow through the throughbore 19 and into the work string below the tool 1.

By observing the aforementioned setting down, and picking up of the weight of the work string above the tool 1, the pins 6, 7 and the slot 12 can be cycled between engaged and disengaged configurations, and thus the ports 16 can be cycled between obturated and open configurations.

Figure 2:
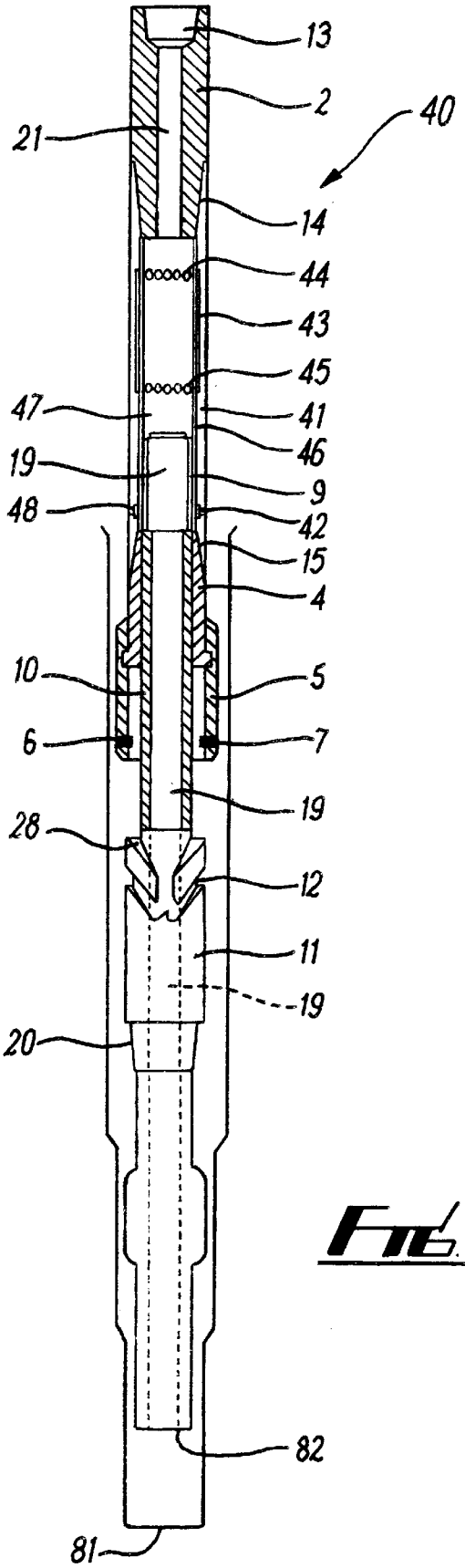
FIG. 2 is a partial cross-sectional view through a second example of a circulating tool.

FIG. 2 shows a tool 40 which is similar to the tool shown in FIG. 1 and the same parts as those in FIG. 1 are indicated with the same reference numerals as for the tool 1 in FIG. 1.

The main difference between the tool 40 and the tool 1, is that the tool 40 is adapted to circulate fluid to the work string below the tool 40 when the pins 6, 7 are disengaged from the slot 12. This is opposite to the function of the tool 1, in which fluid is circulated to the work string below the tool 1 when the pins 6, 7 are engaged in the slot 12.

The main structural difference between the tool 40 and the tool 1 is that the main housing 3 is replaced with a main housing 41 which has outlet ports 42 and incorporates an insert sleeve 46 with an upper series of bypass ports 44, a lower series of bypass ports 45 and a series of outlet ports 48 which coincide with the outlet ports 42 in the housing 41. Between the insert sleeve 46 and the housing 41 is a bypass channel 43 which extends between the upper bypass ports 44 and the lower bypass ports 45. It should also be noted that the external diameter of the piston member 9 is greater than the external diameter of the inner mandrel 10.

The pins 6, 7 and the slot 12 in the tool 40 are identical to those shown in FIGS. 1 and 3 and operate in a similar manner.

Hence, with the piston member 9 in the position shown in FIG. 2, the outlet ports 42, 48 are obturated by the piston member 9 and fluid entering the tool 40 through the through bore 21 enters bore 47 in the insert sleeve 46 and then passes into the through bore 19 in the obturating member to flow through the work string below the tool 40.

When the pins 6, 7 are engaged in the slot 12, the piston member 9 is located between the upper bypass ports 44 and the lower bypass ports 45. Hence, fluid entering the tool 40 through the through bore 21 may enter channel 43 through the upper bypass ports 44 and then exits from the channel 43 through the lower bypass ports 45. As the inner mandrel 10 has an external diameter which is less than the internal diameter of the bore 47, fluid then passes between the inner mandrel 10 and the insert sleeve 46 to ports 48 in the insert sleeve and out through the ports 48 and the ports 42 to washout casing above the liner top.

Accordingly, normally, the tool 40 would be run into the hole with pins 6, 7 disengaged from the slot 12, as shown in FIG. 2. A shoulder, such as a top dress mill 80 located in the work string below the tool 40 would then engage with a suitable shoulder portion in the borehole, such as a liner top 81 to cause the obturating member and in particular the piston member 9 to move upwards towards the top sub 2 and to engage the pins 6, 7 with the slot 12. By picking up weight on the work string, the piston member 9 remains between the bypass ports 44, 45 as the pins 6, 7 are engaged in the slot 12 and it is possible to circulate fluid out through the ports 42 to washout casing above the liner top without requiring the shoulder coupled to the obturating member to be engaged with a shoulder portion, or other formation in the borehole during the washout or fluid circulation procedure.

It is possible to halt circulation of the fluid out through the side of the main housing 41 through the outlet ports 42, 48, and permit the fluid to be repumped through the throughbore 19 by observing the following operation. Setting down of weight, and subsequently lifting up of weight, of the work string above the tool 40, causes the tubular assembly to move so that pins 6, 7 move through the slot 12 until they clear the slot 12 through the exit slots 25. The outlet ports 42, 48 are now obturated by the piston member 9, and accordingly, all the fluid will now flow through the throughbore 19 and into the work string below the tool 40.

By observing the aforementioned setting down, and picking up of the weight of the work string above the tool 40, the pins 6, 7 and the slot 12 can be cycled between engaged and disengaged configurations, and thus the outlet ports 42, 48 can be cycled between obturated and open configurations.

Figure 4B:
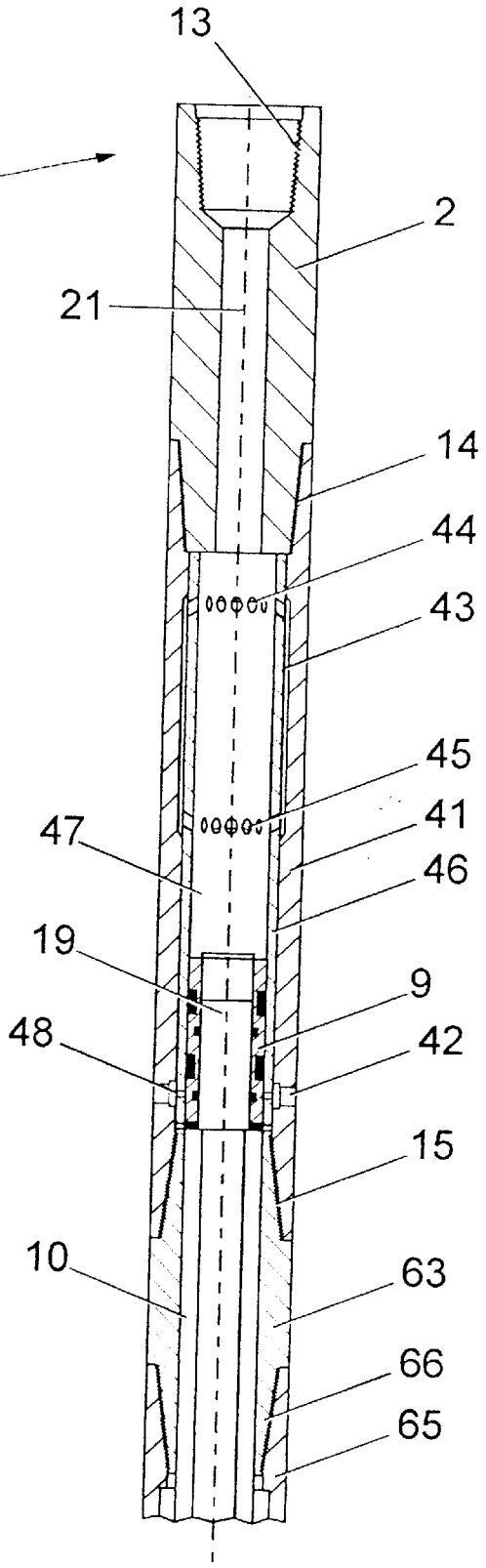

FIGS. 4*a* and 4*b*, and FIG. 5 shows a tool 60 which is similar to the tool 40 shown in FIG. 2 and the same parts are indicated with the same reference numerals as for the tool 40 in FIG. 2.

The main difference between the tool 60 and the tool 40 is that the pins 68 are secured to a pin sub 65 which is threadedly connected at 66 to a middle sub 63 which is further threadedly connected at 15 to the main housing 41. The pins locate in a slot 69 (which can be more clearly seen in FIG. 5) which is formed in a sleeve 67, where the sleeve 67 is rotatably mounted around the outer surface of a mandrel sleeve carrier 71. Thus, the pins 68 are rotationally fixed relative to the tubular assembly.

The mandrel sleeve carrier 71 is connected at its upper end to the inner mandrel 10 and at its lower end to the mandrel bottom sub 11. Thus, the sleeve 67 rotates around the longitudinal axis of the mandrel sleeve carrier 71 as the pin 68 moves through the slot 69.

The slot 69 is broadly similar, in use, to the slot 12 shown in FIG. 3, except that the entry exit slot 25 is replaced by a long slot section 75 such that the pin 68 is permanently located in either of the slot 69 or the long slot section 75.

This example of the tool 60 has the advantage that the outer diameter of the sleeve 67 is less than the outer diameter of the pin sub 65, and thus the sleeve 67 does not snag or otherwise contact the casing during insertion into the borehole. The sleeve 67 or a similar adaptation is suitable for use on the first embodiment.

Optionally, a collet (not shown) can be secured to one of the seal piston member 9 or inner mandrel 10 and is preferably secured to the upper end of the piston member 9. The collet is in the form of an annular spring ring which is permanently biassed outwardly into a recess (not shown) formed in the inner wall of the insert sleeve 46. When the tool is in the configuration shown in FIGS. 4*a* and *b*, the recess is located adjacent the upper end of the seal piston 9, and thus the collet is biassed into the recess. The biassing action of the collet can be overcome by setting down of weight on the string, whilst the top dress mill contacts the shoulder in the borehole, to provide a shear force which acts between the collet and the recess, such that the collet is forced inwardly and is removed from the recess. The collet, shear ring and pin described in relation to the third embodiment is suitable for use in any of the embodiments described, or in any circulating tool generally, and this aspect forms another part of the invention.

Thus, the collet and recess provide a further selective locking of the tool 60 with the outlet ports 42 and 48 obturated.

Further optionally, a second, upper, recess (not shown) can be formed in the insert sleeve 46 immediately below the upper bypass ports 44 such that, when the piston member 9 is located between the bypass ports 44, 45, the collet is urged into the second recess and the tool 60 is again selectively locked. The collet is formed with recess-engaging faces on its upper and lower portions which are the first portions of the collet to engage the recess. The upper face can have a fairly acute angle of incidence with respect to the recess. The angle of incidence of the lower face can be shallower, and this configuration allows the collet to resist upward movement out of the recess, but allow downward movement out of the recess.

In use, the tool 60 (or other tool bearing a collet) is delivered into the hole with the collet locked in the first recess and the pin 68 in the top of the long slot 75. Locking the tool in this way allows it to be forced into deviated wells with high drag without premature actuation of the device. When the tool 60 is in the desired position for circulating fluid, and the shoulder has abutted the formation in the borehole, weight is set down in the string sufficient to force the upper acute-angled face of the collet upwards against the upper edge of the recess, so that the collet is sprung from the recess. The mandrel then moves upwards to the top of the tool, the pin 68 moves down the slot 75 into the slot 69, and the collet moves into and engages the second (upper) recess. Continued force on the string moves the collet out of the second recess and the mandrel upwards until it is fully stroked. At that point the pin 68 is in the slot 69.

Picking up weight in the string then moves the collet back down into the second recess, and the pin 68 moves around the slot 69 to the first apex in the sleeve, at which point the ports are open and the mandrel is locked against further upwards movement by the slot 69 and pin 68. Setting weight down then forces the collet upwards out of the recess, the pin 68 moves to the bottom of the slot 69, and subsequent picking up allows the pin to move to the next long slot 75, the collet to engage in and slide through the second (upper) recess and the mandrel to extend out of the housing, thereby closing the ports.

The addition of the collet and the first or second recesses provides the tool 60 with the advantage that it can be selectively locked with the piston member 9 in either the outer port 42, 48 obturated or opened configurations. This is particularly advantageous when the work string is inserted into a highly deviated well since these operating conditions dictate a high degree of friction between the work string and the borehole. Thus, the addition of the collet and the first and/or second recesses decreases the likelihood that the tool 60 will be operated accidentally into the outlet port 42, 48 opened configuration. The level of biassing of the collet can be varied depending on the operating conditions that the tool 60 will be subjected to. The collet and recess(es) provides the advantage that the cycling of the tool 1,40,60 can be monitored from the surface by monitoring the force needed to cycle the tool through its different configurations.

Further optionally, a shear ring (not shown) or shear pins (not shown) can be included in the tool 60, and which acts between the insert sleeve 46 and a suitable location on one of the seal member 9 or the inner mandrel 10. The shear ring will maintain the seal piston member 9 in a locked position with respect to the main housing 41 until enough weight is set down on the string, whilst the top dress mill contacts the shoulder portion in the borehole, to generate the required shearing force to destruct the shear ring. Thus, the shear ring acts as a one-trip selective locking device.

The addition of the shear ring or shear pins further decreases the likelihood that the tool 60 will be operated accidentally into the outlet port 42, 48 opened configuration during insertion of the string into the borehole. The shear force required to destruct the shear ring or shear pins can be also be varied depending on the operating conditions that the tool 60 will be subjected to.

The addition of a shear ring or shear pins and a collet and associated recesses can be configured such that the shear ring requires a relatively high shear force to unlock, and the collet requires a relatively low shear force to unlock.

The advantages of the tools 1; 40; 60 is that they permit casing above a liner top to be washed out by circulating fluid through the outlet ports 16; 42 without requiring a shoulder to which the obturating member is coupled to be continuously in contact with a shoulder portion or other formation in the well or borehole.

As an alternative to providing a shoulder coupled to the obturating member it is possible that the pins 6, 7; 48 may be engaged and disengaged with the slot 12; 69 by setting the work string 83 (in FIG. 2) down on the bottom 82 of the borehole in order to engage and disengage the pins 6, 7; 48 from the slot 12; 69.

A liner (not shown) may also be run on the workstring with a liner running tool (not shown) included in the workstring. The circulating tool 1; 40; 60 may then be used to displace and clean by means of circulation, mud and cement from the well bore to perform the clean-up. Circulation can take place either down the drill pipe or down the annulus between the casing and the drill pipe.

It should be noted that the preferred features of dependant claims 51 to 55 can also be dependant on claim 27, when claim 27 includes the further step of the work string including a shoulder which is engageable with a formation in the borehole to engage or disengage the engagement mechanism (12, 6, 7; 68, 69), since they are also preferred features of claim 56 also.

Modifications and improvements may be made without departing from the scope of the invention.

What is claimed is:

1. Apparatus for circulating fluid in a borehole comprising a tubular assembly having a through passage between an inlet and a first outlet, the inlet and the first outlet being adapted for connection in a work string, a second outlet extending generally transversely of the tubular assembly; an obturating member moveable between a first position closing the second outlet and a second position permitting fluid flow through the second outlet; and an engagement mechanism actuable between an engaged configuration, in which the obturating member is locked in one of the first and second positions; and a disengaged configuration, in which the obturating member can move to the other of the first and the second positions; wherein the engagement mechanism can lock the obturating member into the engaged configuration when the apparatus is moved in an upwardly direction, and wherein the apparatus is coupled to a shoulder which is adapted to land on a formation in the borehole, wherein the engagement mechanism may be selectively engaged and disengaged solely by said landing on the shoulder formation and without the requirement of inducing movement of the obturating member by a change in fluid pressure.

2. Apparatus according to claim 1, wherein the obturating member is coupled to the shoulder.

3. Apparatus according to claim 1, wherein the formation is provided by a reduction in internal diameter of the well casing or liner.

4. Apparatus according to claim 1, wherein the formation is the bottom of the borehole.

5. Apparatus according to claim 4, wherein the shoulder is the end of the work string closest to the bottom of the borehole.

6. Apparatus according to claim 1, wherein the shoulder is a separate item of equipment located in the work string below the apparatus.

7. Apparatus according to claim 1, wherein the obturating member is axially slidable within the tubular assembly.

8. Apparatus according to claim 1, wherein the engagement mechanism comprises mutually engageable formations on each of the obturating member and the tubular assembly.

9. Apparatus according to claim 8, wherein the engageable formations comprise a second member, and a recess in which the second member is engageable.

10. Apparatus according to claim 9, wherein the second member comprises a pin and the recess comprises a slot.

11. Apparatus according to claim 10, wherein one of the pin and the slot is mounted on the obturating member and the other is mounted on the tubular assembly.

12. Apparatus according to claim 11, wherein the pin is engaged with the slot when the engagement mechanism is in the engaged configuration and the pin is disengaged from the slot when the engagement mechanism is in the disengaged configuration.

13. Apparatus according to claim 10, wherein the slot and/or pin is configured such that the pin and slot move in only one direction with respect to each other when operated.

14. Apparatus according to claim 1, wherein the second outlet comprises a number of apertures in the tubular assembly which communicate with the inlet.

15. Apparatus according to claim 14, wherein the apertures are distributed circumferentially around the tubular assembly.

16. A method of circulating fluid in a borehole comprising inserting a work string into a borehole, the work string having a fluid inlet, a first fluid outlet and a second fluid outlet, an obturating member which is moveable between a first and second position to respectively close and open the second fluid outlet; and an engagement mechanism which when engaged locks the obturating member in one of the first and second positions and wherein the engagement mechanism can lock the obturating member into the engaged configuration when the apparatus is moved in an upwardly direction, and a shoulder which is engageable with a formation in the borehole to engage or disengage the engagement mechanism without the requirement of inducing movement of the obturating member by a change in fluid pressure; passing a desired cleaning fluid through the work string into the fluid inlet and thence via the first outlet to the interior of the borehole; setting down weight on the work string to move the obturating member to the second position to open the second outlet and the engagement mechanism to lock the engaged or disengaged configuration; and passing the cleaning fluid through the work string into the inlet and thence via the second outlet to the interior of the borehole.

17. A method according to claim 16, including picking up weight of the string to reduce a reaction force to the weight of the string exerted by the formation in the borehole on the shoulder.

18. A method according to claim 17, including subsequently resetting down weight on the work string, such that the engagement mechanism is moved to the other of the respective engaged or disengaged configuration to move the obturating member to the first position to close the second outlet.

19. A method according to claim 18, wherein the steps of picking up and setting down the weight of the string are repeated to cycle opening and closing of the second outlet.

20. A method according to claim 16, wherein when the engagement mechanism is disengaged, the obturating member is capable of moving to the respective other position.

21. Apparatus for circulating fluid in a borehole comprising a tubular assembly having a through passage between an inlet and a first outlet, the inlet and the first outlet being adapted for connection in a work string, a second outlet extending generally transversely of the tubular assembly; an obturating member moveable between a first position closing the second outlet and a second position permitting fluid flow through the second outlet; and a locking mechanism which, when locked, maintains the obturating member in one of the first and the second positions; and the apparatus being coupled to a shoulder which is engageable with a formation in the borehole to unlock the locking mechanism without the requirement of inducing movement of the obturating member by a change in fluid pressure.

22. Apparatus according to claim 21, wherein the locking mechanism comprises a locking device coupled to one of the obturating member or the tubular assembly, and which locks with respect to a formation formed on the other of the obturating member or the tubular assembly.

23. Apparatus according to claim 22, wherein the formation is a recess and the locking device is biased into the recess.

24. Apparatus according to claim 23, wherein the locking device is unlocked by a shear force acting between the locking device and the recess.

* * * * *

UNITED STATES PATENT AND TRADEMARK OFFICE

CERTIFICATE OF CORRECTION

PATENT NO. : 6,152,228
DATED : November 28, 2000
INVENTOR(S) : Mark Carmichael

It is certified that error appears in the above-identified patent and that said Letters Patent is hereby corrected as shown below:

Column 4,
Line 24, please change "(not shown)" to -- 80 --.
Lines 53 and 54, please delete "(not shown)".

Column 8,
Line 37, please change "51" to -- 16 --.
Line 37, please change "55" to -- 20 --.
Lines 37 and 38, please change "27" to -- 21 --.
Line 42, please change "56" to -- 21 --.

Signed and Sealed this

Nineteenth Day of March, 2002

*Attest:*

*Attesting Officer*

JAMES E. ROGAN
*Director of the United States Patent and Trademark Office*